US008435091B2

(12) United States Patent
Hoogeveen

(10) Patent No.: US 8,435,091 B2
(45) Date of Patent: May 7, 2013

(54) DISCONNECTABLE MOORING ASSEMBLY

(75) Inventor: Bernardus Cornelis Hendrikus Hoogeveen, Terhijde (NL)

(73) Assignee: Bluewater Energy Services B.V., Hoofddorp (NL)

( * ) Notice: Subject to any disclaimer, the term of this patent is extended or adjusted under 35 U.S.C. 154(b) by 19 days.

(21) Appl. No.: 12/922,506

(22) PCT Filed: Feb. 19, 2009

(86) PCT No.: PCT/EP2009/051952

§ 371 (c)(1),
(2), (4) Date: Oct. 28, 2010

(87) PCT Pub. No.: WO2009/115388

PCT Pub. Date: Sep. 24, 2009

(65) Prior Publication Data

US 2011/0045719 A1 Feb. 24, 2011

(30) Foreign Application Priority Data

Mar. 18, 2008 (EP) ..... 08102706

(51) Int. Cl.
*B63B 22/02* (2006.01)

(52) U.S. Cl.
USPC ..... 441/5

(58) Field of Classification Search ..... 441/3–5
See application file for complete search history.

(56) References Cited

U.S. PATENT DOCUMENTS

| | | | | |
|---|---|---|---|---|
| 5,697,732 | A | 12/1997 | Sigmundstad | |
| 6,050,747 | A * | 4/2000 | Midttveit | 405/224.2 |
| 7,717,762 | B2 * | 5/2010 | Boatman et al. | 441/3 |
| 2007/0202758 | A1 * | 8/2007 | Olsen et al. | 441/5 |
| 2009/0104827 | A1 * | 4/2009 | Seaman et al. | 441/5 |

FOREIGN PATENT DOCUMENTS

| | | |
|---|---|---|
| WO | WO 93/24731 A | 12/1993 |
| WO | WO 93/24732 A | 12/1993 |
| WO | WO 97/00806 A | 1/1997 |

OTHER PUBLICATIONS

Official Search Report of the European Patent Office in counterpart foreign application No. PCT/EP2009/051952 filed Feb. 19, 2009.
Written Opinion of the European Patent Office in counterpart foreign application No. PCT/ EP2009/051952 filed Feb. 19, 2009.

* cited by examiner

*Primary Examiner* — Stephen Avila
(74) *Attorney, Agent, or Firm* — Steven M. Koehler; Westman, Champlin & Kelly, P.A.

(57) ABSTRACT

A disconnectable mooring assembly for a vessel comprises a mooring buoy and a swivel positioned above the mooring buoy. The mooring buoy is provided with a central member for being anchored to the seabed and comprises a number of passages each adapted for receiving a riser. The mooring buoy further comprises an outer member surrounding the central member and capable of a rotation relative thereto. Said outer member is adapted to be housed in and locked to a corresponding receiving opening of the vessel. The swivel is located above the mooring buoy in such a manner that an interspace is defined between the mooring buoy and the swivel.

20 Claims, 2 Drawing Sheets

DISCONNECTABLE MOORING ASSEMBLY

CROSS-REFERENCE TO RELATED APPLICATION

This application is a Section 371 National Stage Application of International Application PCT/EP2009/051952 filed Feb. 19, 2009 and published as WO 2009/115388 in English.

BACKGROUND

The discussion below is merely provided for general background information and is not intended to be used as an aid in determining the scope of the claimed subject matter.

Aspects of invention relate to a disconnectable mooring assembly for a vessel, comprising a mooring buoy and a swivel positioned above the mooring buoy, wherein the mooring buoy is provided with a central member for being anchored to the seabed and comprising a number of passages each adapted for receiving a riser, the mooring buoy further comprising an outer member surrounding the central member and capable of a rotation relative thereto, which outer member is adapted to be housed in and locked to a corresponding receiving opening of the vessel.

Such a disconnectable mooring assembly allows a vessel to weathervane around the mooring buoy for minimising loads resulting from external factors, such as wind, current and waves. Under severe conditions (for example at the arrival of a hurricane) the mooring buoy can be disconnected from the vessel and the vessel can navigate to a safe location.

The swivel of such a mooring assembly provides a rotating connection between the risers of the mooring buoy and corresponding lines on board of the vessel, which have a variable position relative to each other as a result of the vessel weathervaning around the mooring buoy (more specifically the central member of the mooring buoy) which basically is kept geostatic by anchor lines connecting the mooring buoy to the seabed.

In a known disconnectable mooring assembly of the above type the swivel is connected directly on top of the mooring buoy (more specifically the central member thereof) and supported thereby in the operational position of the mooring assembly.

Such a state of the art configuration, however, has a number of drawbacks. For connecting and disconnecting (e.g. a controlled lowering through wire/hoisting means) the outer member of the mooring buoy to and from, respectively, the vessel the respective region of the vessel (which generally is located near the keel of the vessel) has to be accessible, such as for (de)bolting, cleaning and inspection. This means that the swivel has to be moved to a position away from the mooring buoy. This calls for complicated moving mechanisms and when the swivel is moved upward or sideward such a movement requires a respective receiving space to be defined in the vessel as well as flexible lines that need to be disconnected or that need to be able to cope with an upward and/or sideward moving swivel (typically with less reliable jumper hoses); in addition the moving mechanisms require a high position flexibility and position accuracy for re-connection of the (typically heavy) swivel on top of the mooring buoy.

Similar disadvantages are valid for the connections between the mooring member and the swivel. In the operational position of the mooring assembly (swivel connected to and supported by the mooring buoy) the presence of the swivel makes the establishment or disconnection of such connections difficult, whereas an inspection and maintenance of such connections is very troublesome. In addition, space between the mooring buoy and the swivel is known to be small and is troublesome for inspection, maintenance and manifold features, such as control racks and pig handling (the need for pig launchers and/or receivers between mooring buoy and swivel).

A further disadvantage is, that during operation the weight of the swivel is supported by the mooring buoy, which adds to the loads on the bearing between the central member and the outer member of the mooring buoy, and indirectly to the loads acting on the vessel at said region.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

In accordance with an aspect of the present invention, a disconnectable mooring assembly includes a swivel located above the mooring buoy in such a manner that an interspace is defined between the mooring buoy and the swivel.

Depending on the specific embodiments of the inventive disconnectable mooring assembly, among others the following advantages are offered, alone or in combination:

- connecting the mooring buoy to a vessel or disconnecting it therefrom can be carried out easier and with less complicated means, such that a shorter response time is achieved on altering conditions (e.g. an arriving hurricane) as well as a reduced production downtime;
- there is no need for complicated means and/or structures for moving the swivel to a position away (e.g. sideward) from the mooring buoy; the swivel may remain in its original position during connect and disconnect procedures and relative flexible connections may take care of the alignment between the swivel and mooring buoy;
- the connections (e.g. large and small bore piping, optical, control and power cables, bolting and clamping devices) between the mooring buoy and swivel are readily accessible, making inspection, maintenance, and the establishment and disconnection thereof easier and thus more reliable and, thus, safer;
- the loads on the mooring buoy and on the respective region of the vessel are minimised due to the removal of swivel loads, allowing a larger swivel (independent from the mooring buoy) and larger mooring loads within an existing mooring assembly;
- the interspace between the mooring buoy and the swivel allows the introduction of hoisting devices required for lifting or lowering the mooring buoy during connect or disconnect operations as well as the provision of (advanced) manifolding between the swivel and the mooring buoy;
- under circumstances the number of risers passing through the mooring buoy may be increased.

A number of illustrative embodiments of the disconnectable mooring assembly are briefly discussed below.

When the swivel has a stationary position relative to and is supported substantially entirely by the vessel, the overall constructive measures can be minimised.

When the swivel is supported in the vessel by means of a bearing assembly, a direct transmission of the weight of the swivel towards the vessel is obtained.

It is noted, that a swivel basically comprises components stationary with respect to the vessel and components rotating with respect thereto. The latter components are supported by means of the said bearing assembly.

It is possible that the swivel at least partly extends below the level of the deck of the vessel. In such a case the swivel is received in a recess in the deck of the vessel. Said recess may or may not be enclosed and/or made inert.

Alternatively, the swivel extends above the level of the deck of the vessel, which may improve the access to components of the assembly.

To ensure that the components of the swivel rotating relative to the vessel do maintain a rotational position in unison with the central member of the buoy without applying a torque on lines connecting the mooring buoy to the swivel, it is possible that the central member of the mooring buoy and the swivel are interconnected by a torque member, for example a centrally positioned, vertically extending torque rod.

BRIEF DESCRIPTION OF THE DRAWINGS

Aspects of the invention will be elucidated while referring to the drawing in which embodiments thereof are illustrated.

DETAILED DESCRIPTION OF THE ILLUSTRATIVE EMBODIMENTS

Figure 1:
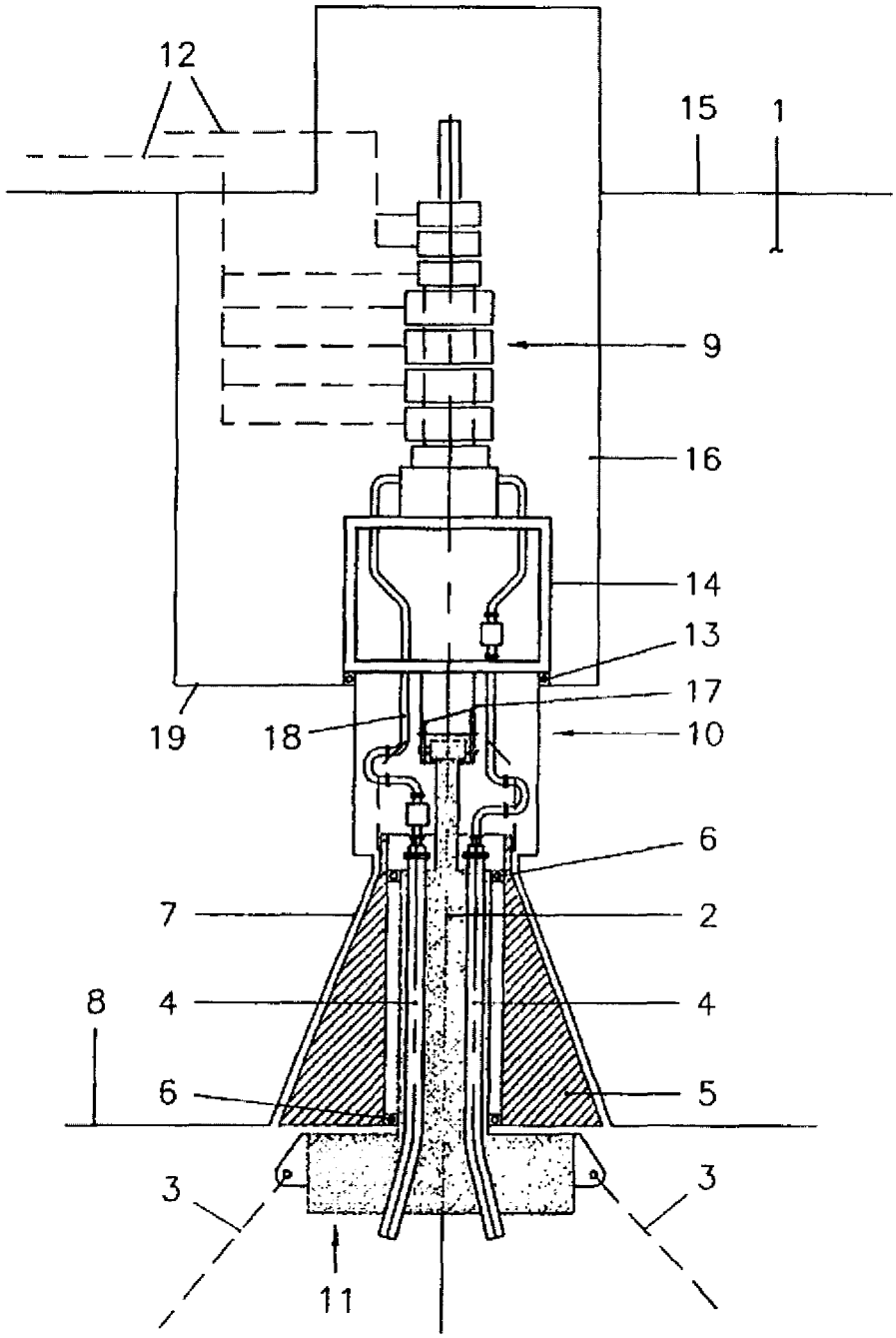
FIG. 1 shows, in a schematical side elevational and sectional view of a first embodiment of the disconnectable mooring assembly.

Firstly referring to FIG. 1 a disconnectable mooring assembly for a vessel 1 is illustrated. It comprises a mooring buoy 11 which is provided with a central member 2 for being anchored to the seabed by anchor lines 3 and further comprises a number of passages each adapted for receiving a riser 4. Said risers may be connected, for example, to a sub sea oil or gas well and can be connected at the lower end of the mooring buoy or can be (partly) pulled through the mooring buoy 11.

The mooring buoy 11 further comprises an outer member 5 surrounding the central member 2 and capable of a rotation relative thereto (see, for example, bearing assemblies 6). The outer member 5 is adapted to be housed in and locked (by appropriate releasable locking devices not illustrated here, but known per se) to a corresponding receiving opening 7 of the vessel 1 (generally, but not exclusively, located in the region of the keel 8 of the vessel 1).

The disconnectable mooring assembly further is provided with a swivel 9 positioned at such a level above the mooring buoy 11 that an interspace 10 is defined between the mooring buoy 11 and the swivel 9.

Basically the swivel 9 may be of a known type and therefore a detailed description thereof will not be needed within the context of the present invention. It only is noted in general, that such a swivel 9 provides a rotating connection between the risers 4 of the mooring buoy 11 and corresponding lines 12 on board of the vessel 1, which have a variable position relative to each other as a result of the vessel weathervaning around the mooring buoy 11 (more specifically the central member 2 of the mooring buoy 11) which basically is kept geostatic by the anchor lines 3 connecting the mooring buoy 11 to the seabed.

The expression that the swivel 9 has a stationary position relative to the vessel 1 means that its general position will remain the same, also during connecting and/or disconnecting the mooring buoy 11. Of course the swivel 9 will comprise components which will rotate relative to the vessel 1, but still in total the swivel 9 is considered to be stationary.

The swivel 9 is supported in the vessel 1 by means of a bearing assembly 13 positioned between the vessel 1 and a swivel support frame 14.

In the embodiment illustrated in FIG. 1 the swivel 9 at least partly extends below the level of the deck 15 of the vessel 1. Specifically, the swivel 9 is received in a respective recess 16 in the deck 15 of the vessel 1.

Because the rotating components of the swivel 9 should rotate in unison with the central member 2 of the buoy member 11 relative to the vessel 1 when latter weathervanes around the buoy member 11, the central member 2 of the mooring buoy and the swivel 9 are interconnected by a torque member 17 which, as illustrated here, is connected to the swivel support frame 14. As a result lines 18 connecting the risers 4 to corresponding lines (not shown in detail) within the swivel 9 will not be torqued.

In one embodiment, the torque member 17 is a centrally positioned, vertically extending torque rod, but also other embodiments are conceivable. Generally, the torque member 17 will be designed such that swivel 9 supporting loads on the mooring buoy 11 are eliminated or at least minimised.

Figure 2:
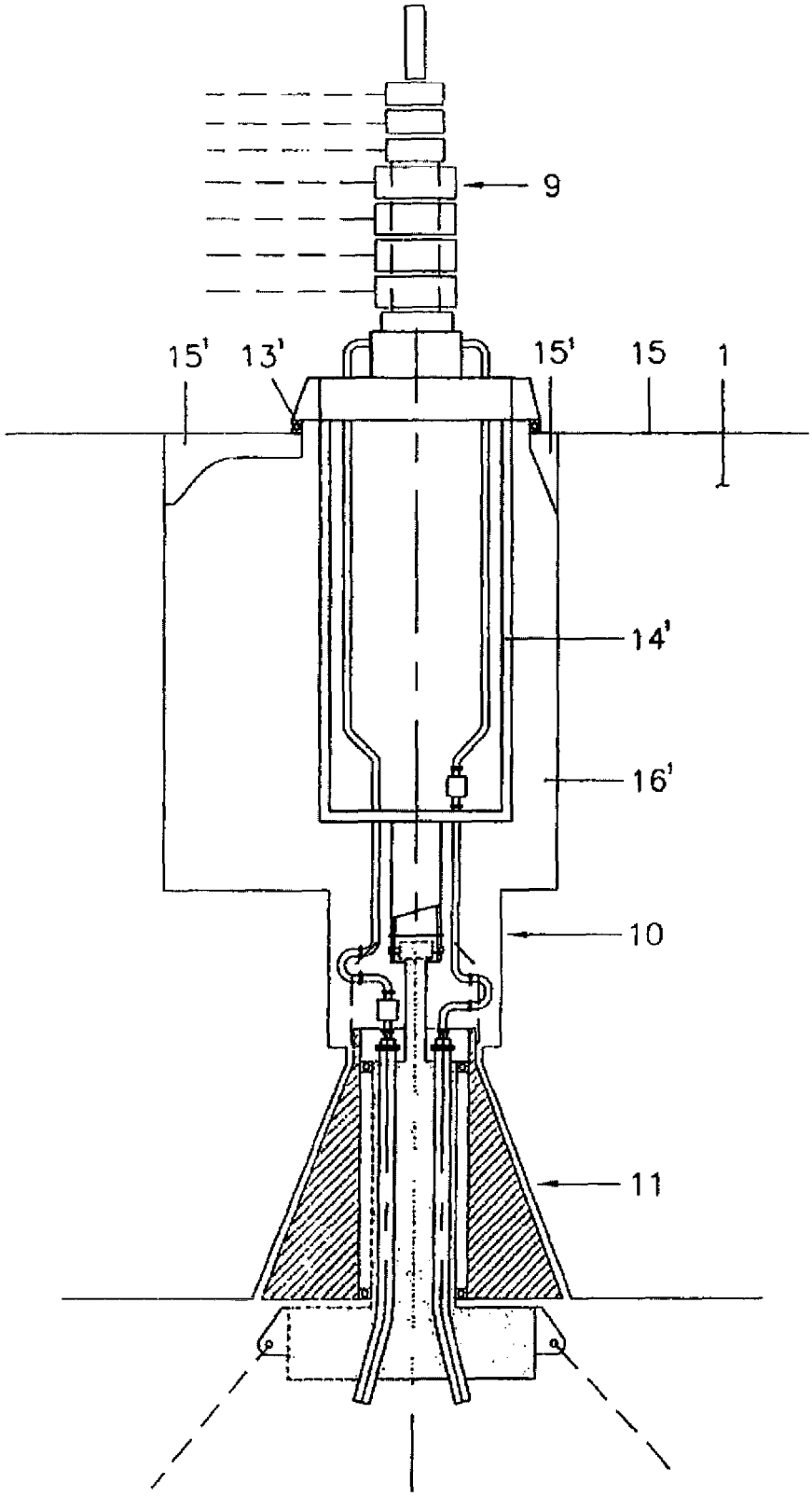
FIG. 2 shows, in a schematical side elevational and sectional view of a second embodiment of the disconnectable mooring assembly.

Referring to FIG. 2 an alternative embodiment of the disconnectable mooring assembly is illustrated in a view similar to FIG. 1. Most of the components of this alternative embodiment are similar to components of the first embodiment, and thus are not explained again. The main difference with the previous embodiment is the feature that the swivel 9 now extends above the level of the deck 15 of the vessel 1. The swivel support frame 14' now is prolonged in a vertical direction compared to swivel support frame 14 of the FIG. 1 embodiment. Whereas according to FIG. 1 the bearing assembly 13 is provided at the lower side of the swivel support frame 14 and cooperates with a bottom wall 19 of the recess 16 in the deck 15 of the vessel, according to FIG. 2 the upper end of the swivel support frame 14' carries a bearing assembly 13' cooperating with the deck 15 of the vessel or mounts 15' attached thereto.

The swivel support frame 14' again is housed partly in a recess 16'. The lower end of the swivel support frame 14' now does not contact the bottom of the recess 16'.

Although the above embodiments have been described with respect to a mooring assembly in which the mooring buoy is received in a corresponding receiving opening near to or at the keel of the vessel (that means within the confines of the hull of the vessel), it is noted that the scope of the invention is not limited to such embodiments. It is conceivable too that the mooring buoy is received in a receiving opening defined elsewhere. Specifically it is possible to provide such a receiving opening in an outrigger connected to and projecting from the vessel, such that the mooring assembly then is positioned at least partially, and often fully outside the confines of the hull of the vessel.

The invention is not limited to the embodiments described above which may be varied widely within the scope of the invention as defined by the appending claims.

The invention claimed is:

1. A disconnectable mooring assembly for a vessel, comprising:

a mooring buoy provided with a central member configured to be anchored to the seabed and comprising a number of passages each configured for receiving a riser, the mooring buoy further comprising an outer member surrounding the central member and capable of a rotation relative thereto, which outer member is configured to be housed and locked in a corresponding receiving opening of the vessel;

a swivel having a swivel support frame;

a bearing assembly configured to be mounted to the vessel between the swivel support frame and the vessel such that the swivel is supported substantially entirely in the vessel by the bearing assembly, the bearing assembly supporting the swivel in a stationary, fixed position above the mooring buoy in such a manner that an interspace is defined between the mooring buoy and the swivel with the mooring assembly in an operative position to transfer fluid between the mooring buoy and the swivel, the interspace allowing introduction of hoisting devices for lifting or lowering the mooring buoy during connect or disconnect operations; and a manifold assembly having a length configured to extend through the interspace and connect the risers to the swivel in the stationary position to transfer fluid between the mooring buoy and the swivel.

2. The disconnectable mooring assembly according to claim 1, wherein the swivel at least partly extends below a level of a deck of the vessel.

3. The disconnectable mooring assembly according to claim 2, wherein the swivel is received in a recess in the deck of the vessel.

4. The disconnectable mooring assembly according to claim 1, wherein the swivel extends above a level of a deck of the vessel.

5. The disconnectable mooring assembly according to claim 1, wherein the central member of the mooring buoy and the swivel are interconnected by a torque member.

6. The disconnectable mooring assembly according to claim 1, wherein the central member of the mooring buoy and the swivel are interconnected by a torque member.

7. The disconnectable mooring assembly according to claim 2, wherein the central member of the mooring buoy and the swivel are interconnected by a torque member.

8. The disconnectable mooring assembly according to claim 4, wherein the central member of the mooring buoy and the swivel are interconnected by a torque member.

9. The disconnectable mooring assembly according to claim 1, wherein the swivel at least partly extends below a level of a deck of the vessel.

10. The disconnectable mooring assembly according to claim 1, wherein the swivel extends above a level of a deck of the vessel.

11. The disconnectable mooring assembly according to claim 1, wherein the swivel comprises components stationary with respect to the vessel and components rotatable with respect to the vessel.

12. A vessel comprising:

a portion having a receiving opening configured to removably receive a mooring buoy therein; and a swivel supported by the vessel and located above the receiving opening such that an interspace is defined between the mooring buoy and the swivel when the mooring buoy is secured within the receiving opening and operably connected to transfer fluid between the mooring buoy and the swivel while the swivel is in a stationary, fixed position relative to the receiving opening, the interspace configured to accommodate hoisting devices between the mooring buoy and the swivel for lifting or lowering the mooring buoy with respect to the swivel when the swivel is in the stationary, fixed position relative to the receiving opening.

13. The vessel of claim 12, wherein the mooring buoy is provided with a central member configured to be anchored to the seabed and comprising a number of passages each adapted for receiving a riser, the mooring buoy further comprising an outer member surrounding the central member and capable of a rotation relative thereto.

14. The vessel of claim 13, and further comprising a torque member configured to interconnect the central member of the mooring buoy and the swivel.

15. The vessel of claim 12, wherein the swivel comprises components stationary with respect to the vessel and components rotatable with respect to the vessel.

16. The vessel of claim 12, wherein the swivel is at least partially received in a recess in a deck of the vessel.

17. The vessel of claim 12, wherein the swivel extends above a level of a deck of the vessel.

18. A method for connecting a mooring buoy to a swivel on a vessel, the swivel being located in a stationary, fixed position on the vessel above a receiving opening for the mooring buoy, the method comprising:

lifting the mooring buoy into the receiving opening of the vessel using a hoisting device with the swivel in the stationary, fixed position on the vessel;

securing the mooring buoy in the receiving opening of the vessel with the swivel located in the stationary, fixed position on the vessel to define an interspace between the mooring buoy and the swivel, the interspace accommodating the hoisting device; and connecting a manifold assembly to transfer fluid between the mooring buoy and the swivel in the stationary, fixed position on the vessel, the manifold assembly having a length configured to extend through the interspace.

19. The method of claim 18, and further comprising:

disconnecting the manifold assembly; and lowering the mooring buoy from the receiving opening with the swivel in the stationary, fixed position on the vessel.

20. The vessel of claim 12, and further comprising:

a bearing assembly mounted to the vessel and the swivel support frame, the bearing assembly supporting the swivel in the stationary, fixed position, the bearing assembly configured to allow rotation of the swivel support frame relative to the vessel.

* * * * *

UNITED STATES PATENT AND TRADEMARK OFFICE

CERTIFICATE OF CORRECTION

PATENT NO. : 8,435,091 B2
APPLICATION NO. : 12/922506
DATED : May 7, 2013
INVENTOR(S) : Bernardus Cornelis Hendrikus Hoogeveen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 57 days.

Signed and Sealed this
Eighth Day of September, 2015

Michelle K. Lee

Michelle K. Lee
*Director of the United States Patent and Trademark Office*